US010589764B2

(12) United States Patent
Wang et al.

(10) Patent No.: US 10,589,764 B2
(45) Date of Patent: Mar. 17, 2020

(54) DETERMINING ROOT CAUSE OF LOCOMOTIVE FAILURE

(71) Applicant: General Electric Company, Schenectady, NY (US)

(72) Inventors: Chris J. Wang, San Ramon, CA (US); Abhishek Narain, Bangalore (IN); Vikram Lakshmipathy, San Ramon, CA (US)

(73) Assignee: General Electric Company, Schenectady, NY (US)

( * ) Notice: Subject to any disclaimer, the term of this patent is extended or adjusted under 35 U.S.C. 154(b) by 294 days.

(21) Appl. No.: 15/497,812

(22) Filed: Apr. 26, 2017

(65) Prior Publication Data

US 2018/0312180 A1 Nov. 1, 2018

(51) Int. Cl.

| | |
|---|---|
| ***G06F 17/30*** | (2006.01) |
| ***B61L 15/00*** | (2006.01) |
| ***B61L 27/00*** | (2006.01) |

(52) U.S. Cl.

CPC ..... *B61L 15/0081* (2013.01); *B61L 15/009* (2013.01); *B61L 15/0072* (2013.01); *B61L 27/0094* (2013.01)

(58) Field of Classification Search

CPC ..... B61L 15/0081; B61L 27/0094; B61L 15/009; B61L 15/0072

See application file for complete search history.

(56) References Cited

U.S. PATENT DOCUMENTS

| | | | | |
|---|---|---|---|---|
| 5,445,347 A * | 8/1995 | Ng | B60L 3/12 | 246/169 R |
| 2002/0026537 A1* | 2/2002 | Schlabach | B61L 27/0094 | 710/1 |
| 2016/0025027 A1* | 1/2016 | Mentele | F02D 41/22 | 701/102 |

* cited by examiner

*Primary Examiner* — Nga X Nguyen

(74) *Attorney, Agent, or Firm* — Buckley, Maschoff & Talwalkar LLC

(57) ABSTRACT

The example embodiments are directed to a device and method for determining a root cause of equipment failure. In one example, the method includes storing a plurality of root causes of previous equipment failures, receiving textual data associated with a current equipment failure, determining a root cause for the current equipment failure by determining a similarity of keywords of each root cause with respect to the received textual data of the current equipment failure and selecting at least one root cause based on the determined similarities of the plurality of root causes, and displaying the at least one determined root cause for the current equipment failure via a display device. The example embodiments provide a system and method that automatically determine a root cause of equipment failure rather than rely on a subject matter expert.

21 Claims, 6 Drawing Sheets

FIG. 2

Equation 1

$$weight(t) = \frac{|\{d \in D : t \in T_d \cap RCC_d\}|}{|\{d \in D : t \in T_d\}|}$$

Equation 2

$$similarity(T, RCC) = \sum_{w \in (T \cap RCC)} \frac{weight(w)}{|\{e \in RCC\}|}$$

200

| Text (220) | RCC (230) | Text Similarity Score (240) |
|---|---|---|
| ....water...pressure....gas | Water Pump (231) | ((2/4) + 0) / 2 = **0. 250** |
| ....water...pressure....gas | Water Pressure | ((2/4) + (2/3)) / 2 = **0.583** |
| ....water...pressure....gas | High Pressure Fuel Pipe | (0+(2/3)+0+0) / 2 = **0.333** |
| ....water.....gas | Power Assembly | (0 + 0) / 2 = **0.000** |
| ...gas...Panel.... | A2A Panel | (1 + 0) / 2 = **0.500** |

210

| | |
|---|---|
| weight(water) = | 2/4 |
| weight(gas) = | 0/5 |
| weight(Panel) = | 1/1 |
| weight(pressure) = | 2/3 |

FIG. 3

300

| | RCC 1 | RCC 2 | RCC 3 | RCC 4 | RCC 5 |
|---|---|---|---|---|---|
| Work Order 1 | 0.54 | 0.46 | 0.61 | 0.09 | 0.00 |
| Work Order 2 | 0.36 | 0.08 | 0.68 | 0.33 | 0.07 |
| Work Order 3 | 0.61 | 0.00 | 0.45 | 0.12 | 0.56 |
| Max | 0.61 | 0.46 | 0.68 | 0.33 | 0.56 |

310

Top 3 Recommendations

| | |
|---|---|
| Work Order 1 | RCC 1, RCC 2, RCC 3 |
| Work Order 2 | RCC 1, RCC 3, RCC 4 |
| Work Order 3 | RCC 1, RCC 2, RCC 5 |

DETERMINING ROOT CAUSE OF LOCOMOTIVE FAILURE

BACKGROUND

Machine and equipment assets, generally, are engineered to perform particular tasks as part of a business process. For example, assets can include, among other things and without limitation, industrial manufacturing equipment on a production line, drilling equipment for use in mining operations, wind turbines that generate electricity on a wind farm, transportation vehicles such as trains and aircraft, and the like. As another example, assets may include devices that aid in diagnosing patients such as imaging devices (e.g., X-ray or MRI systems), monitoring equipment, and the like. The design and implementation of these assets often takes into account both the physics of the task at hand, as well as the environment in which such assets are configured to operate.

Low-level software and hardware-based controllers have long been used to drive machine and equipment assets. However, the rise of inexpensive cloud computing, increasing sensor capabilities, and decreasing sensor costs, as well as the proliferation of mobile technologies have created opportunities for creating novel industrial and healthcare based assets with improved sensing technology and which are capable of transmitting data that can then be distributed throughout a network. As a consequence, there are new opportunities to enhance the business value of some assets through the use of novel industrial-focused hardware and software.

A locomotive (also referred to as an engine) provides motive power to push and pull rail cars holding cargo such as freight, passengers, and the like. The life of a locomotive can span forty years or more and requires continuous upkeep. Railroads are always under pressure to improve operating efficiency, enhance locomotive reliability, and control cost of locomotives. One of the biggest expenditures is in the maintenance and upkeep of locomotives. Unplanned maintenance activity, such as road failures, can be significantly more expensive to address than planned maintenance activity. To make matters worse, while the locomotive is being repaired, the locomotive is unavailable resulting in lost revenue.

A road failure event typically prevents a locomotive from reaching its final destination. Instead, the locomotive is transported from the point of failure to a workshop where it can be evaluated and fixed before being placed back into operation. It is estimated that more than 40,000 road failures occur each year. Identifying a root cause of a road failure event can help prevent them from happening in the future. Troubleshooting and identifying a root cause of a failure is typically performed by a subject matter expert on locomotives such as a fleet program manager. The expert reviews the information around the failure event, repair logs, maintenance notes, and other information, and provides a "best-guess" as to the cause of the failure. However, there are hundreds of factors that can cause a road failure. As a result, two experts reviewing the same information often come to different conclusions.

SUMMARY

Embodiments described herein improve upon the prior art by providing systems and methods to automatically determine a root cause of equipment failure based on multiple sources of information. As described herein the equipment may refer to manufacturing, energy, healthcare, or other types of equipment and/or machinery. The auto determined root cause may be generated almost instantaneously and may be used to supplement or to replace an opinion of a subject matter expert. Such embodiments provide a technical solution to the problems that come from relying on subject matter experts (i.e., human actors) to provide a best-guess as to the cause of the equipment failure which can take weeks and which can be unreliable because it is based on a subjective opinion of the expert.

In an aspect of an example embodiment, a computing system is provided that includes a storage to store information about a plurality of root causes of historical equipment failures and respective keywords associated with each root cause, a network interface to receive textual data associated with a current equipment failure, a processor to determine a similarity for each root cause, from among the plurality of root causes, with respect to the current equipment failure, by determining a similarity of the keywords of a root cause and the received textual data of the current equipment failure, and select at least one root cause for the current equipment failure based on the determined similarities of the plurality of root causes, and an output to provide information about the at least one selected root cause for the current equipment failure for display on a display device.

In an aspect of another example embodiment, a computer-implemented method is provided that includes storing information about a plurality of root causes of historical equipment failures and respective keywords associated with each root cause, receiving textual data associated with a current equipment failure, determining a similarity for each root cause, from among the plurality of root causes, with respect to the current equipment failure, by determining a similarity of the keywords of the root cause and the received textual data of the current equipment failure, selecting at least one root cause for the current equipment failure based on the determined similarities of the plurality of root causes, and outputting information about the at least one selected root cause for the current equipment failure for display on a display device.

In an aspect of another example embodiment, a non-transitory computer readable medium is provided that includes instructions that when executed cause a computer to perform a method that includes storing a plurality of root causes of historical equipment failures, each root cause being associated with respective keywords, receiving textual data associated with a current equipment failure, determining at least one root cause for the current equipment failure by comparing the received textual data of the current equipment failure and the respective keywords of the plurality of root causes of the historical equipment failures, and outputting information about the at least one determined root cause for the current equipment failure for display on a display device.

Other features and aspects may be apparent from the following detailed description taken in conjunction with the drawings and the claims.

BRIEF DESCRIPTION OF THE DRAWINGS

Features and advantages of the example embodiments, and the manner in which the same are accomplished, will become more readily apparent with reference to the following detailed description taken in conjunction with the accompanying drawings.

FIG. 2 is a diagram illustrating an example of determining weights for keywords of root causes and calculating similarities based thereon, in accordance with an example embodiment.

FIG. 3 is a diagram illustrating an example of determining root causes of locomotive failure in accordance with an example embodiment.

Figure 1:
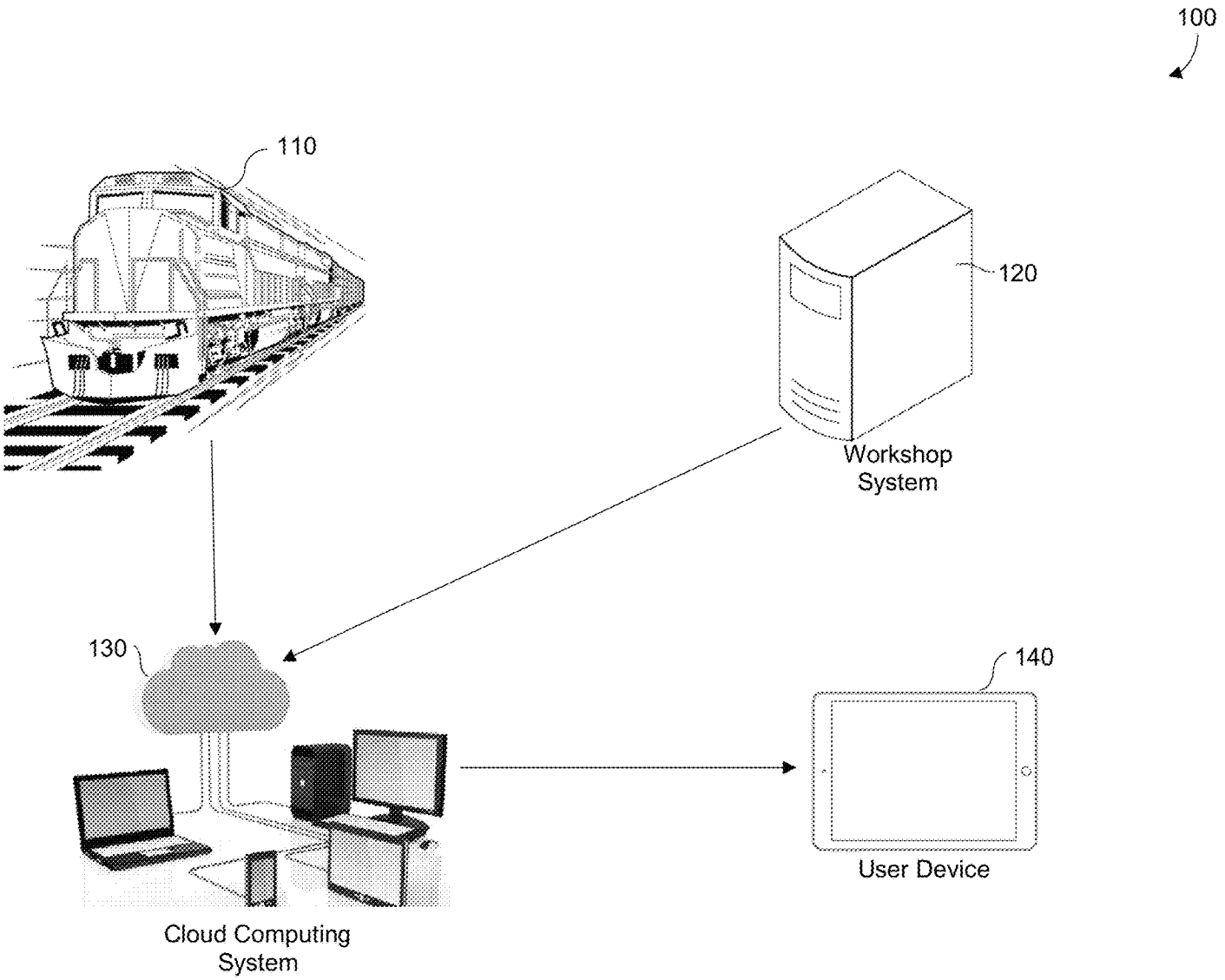
FIG. 1 is a diagram illustrating a cloud computing environment for determining cause of locomotive failure in accordance with an example embodiment.

Throughout the drawings and the detailed description, unless otherwise described, the same drawing reference numerals will be understood to refer to the same elements, features, and structures. The relative size and depiction of these elements may be exaggerated or adjusted for clarity, illustration, and/or convenience.

DETAILED DESCRIPTION

In the following description, specific details are set forth in order to provide a thorough understanding of the various example embodiments. It should be appreciated that various modifications to the embodiments will be readily apparent to those skilled in the art, and the generic principles defined herein may be applied to other embodiments and applications without departing from the spirit and scope of the disclosure. Moreover, in the following description, numerous details are set forth for the purpose of explanation. However, one of ordinary skill in the art should understand that embodiments may be practiced without the use of these specific details. In other instances, well-known structures and processes are not shown or described in order not to obscure the description with unnecessary detail. Thus, the present disclosure is not intended to be limited to the embodiments shown, but is to be accorded the widest scope consistent with the principles and features disclosed herein.

The example embodiments herein describe a system and method for determining a root cause of equipment or machine failure. The system may analyze previous opinions of one or more subject matter experts in the field of particular machine or equipment, and automatically generate an opinion based on previous determinations of the subject matter experts. In the examples herein, a locomotive is used as an example of the machine or equipment, however, the embodiments are not limited thereto and may include other machinery or equipment such as healthcare machines, oil rigs, mining equipment, manufacturing machinery/equipment, chemical processing machinery, and the like.

Locomotives are self-powered vehicles used for pushing or pulling rail cars on railroad tracks from departure to destination. Locomotives include dozens of components that are each capable of breaking down such as a generator, an air pump, boilers, valves, tubes, hoses, and the like. Furthermore, each component may have multiple different possibilities of failure. As a result, there are hundreds of factors that can cause a road failure event to happen. A road failure event is a serious issue and often prevents a locomotive from approaching and reaching its destination. When a road failure occurs, the locomotive is usually transported to a workshop (i.e., a shop) where it can be evaluated by experts on locomotive failures and repaired. As referred to herein, a failure event may refer to any unscheduled event which results in a locomotive being impaired, including a complete breakdown of the locomotive or any damage or injury to the locomotive that requires repairs or replacement parts.

In the present art, analysis of locomotive road failure root cause is limited by domain expertise and time constraints. Fleet Program Managers (FPMs) skilled in the subject of locomotive failures analyze a failure event based on their expertise knowledge by reviewing information of the road failure such as symptoms, preliminary diagnosis by field engineers, parts replaced, repair notes, etc. The data can and usually comes from various sources and contains large amounts of text written by different engineers. Relying on FPMs to determine a root cause of a failure event has significant limitations. For example, the determination requires deep expertise and understanding of the engineering and mechanics about locomotives to troubleshoot the root cause of road failures. In addition, the process is inefficient and time consuming (e.g., multiple weeks or even months) due to the significant manual labor involved in reviewing a large amount of text data from different sources. Furthermore, the process requires significant subjective judgment, and as a result, human errors can occur frequently.

The example embodiments provide a solution to relying on human actors to determine the cause of road failures by automatically identifying a root cause of a locomotive failure and providing customers with an identification of issues that need to be addressed. By analyzing the locomotive defect information, work orders, repair notes, material usages, and the like, the example embodiments recommend one or a small list of potential root causes (e.g. water leak, high pressure fuel pipe, etc.) from a historical root cause pool that includes hundreds and in some cases even thousands of choices. The recommendation may be used to helps FPMs assess the issues of road failures efficiently and accurately or even to replace FPM assessments all together. Although a locomotive failure is used in the examples herein, the failure could be associated with any type of machine or industrial system that requires a subject matter expert opinion, for example, a wind turbine, an oil rig, a healthcare machine, a gas turbine, and the like.

FIG. 1 illustrates a cloud-based system 100 for determining a root cause of locomotive failure in accordance with an example embodiment. Referring to FIG. 1, the system 100 includes a locomotive 110, a workshop system 120, a cloud computing platform 130 that represents a cloud-based environment according to various embodiments, and a user device 140. It should be appreciated that the system 100 is merely an example and may include additional devices and/or one of the devices shown may be omitted. The locomotive 110 may include any type of locomotive such as a steam locomotive, diesel locomotive, electric locomotive, and the like. In some cases, the locomotive 110 can provide information directly to the cloud computing system 130. The workshop system 120 may be a computer, a server, a notebook, a tablet, a mobile device, a workstation, and the like, included at a repair workshop which performs maintenance and repairs on locomotives. The workshop system 120 may include repair notes, material usage information, diagnosis information, and the like, about a road failure event, which can be uploaded to the cloud computing platform 130. The cloud computing platform 130 may be one or more of a server, computer, database, and the like, included in a cloud-based platform. The user device 140 may include a computer, a laptop, a tablet, a mobile device, a television, an appliance, a kiosk, and the like. In the example of FIG. 1, the locomotive 110, the workshop system 120, and/or the user device 140 may be connected to the cloud computing system 130 via a network such as the Internet.

Locomotive data, for example, textual based data may be transmitted to the cloud computing system 130 by one or more of the workshop system 120, the locomotive 110, or another device or cloud, and be analyzed by an application hosted by the cloud computing platform 130 that is capable of determining a root cause of a locomotive failure. As an example, the textual data may include machine parameter readings, repair comments, material usage descriptions, symptom descriptions, defect descriptions, action comments, incident descriptions, part descriptions, root cause descriptions, symptom codes, and the like. The application hosted on the cloud platform may be used to generate actionable insights from the locomotive data based on previously determined causes of locomotive failures. These insights may include root causes of locomotive failure and may be used to improve safety, efficiency, and behavior of locomotives which can enable operators to proactively and effectively manage risk. For example, one or more repairs and preventive maintenance may be performed on a locomotive 110 to prevent future road failures from occurring based on the determined root cause of locomotive failure. Locomotive failure analysis is also widely used in support of maintenance and engineering of a locomotive by optimizing usage, reducing emissions, improving safety concerns, and improving locomotive component life. The locomotive failure determining application described herein has been tested and proven to be just as accurate if not more accurate than a subject matter expert.

The locomotive data may be transmitted to a central database such as the cloud computing platform 130 for automated processing, analysis by trained personnel, and dissemination to operational managers for action. For example, the cloud computing platform 130 may facilitate the transmission of data, automatic and continuous processing of the data (including data filtering and organization, correlation with other data sources, and identification of significant events and measurements), human analysis of the processed data, presentation of results (e.g., displays, printouts, etc.), monitoring of the effectiveness of corrective actions taken based thereon, and the like. The cloud computing platform 130 may include at least one processor circuit, at least one database, and a plurality of users or assets that are in data communication with a cloud computing system. The cloud computing platform 130 can further include or can be coupled with one or more other processor circuits or modules configured to perform a specific task, such as to perform tasks related to asset maintenance, analytics, data storage, security, or some other function.

The cloud computing platform 130 may be an Internet of Things (IoT) platform or an Industrial Internet of Things (hot) platform. For example, the system and application for determining the cause of locomotive failure described herein can be hosted by an IIoT such as the Predix™ platform available from GE. The IIoT may connect equipment and machine assets from industrial fields and healthcare fields, such as turbines, jet engines, healthcare machines, and locomotives, to the Internet or cloud, or to each other in some meaningful way such as through one or more networks. In this example, the cloud can be used to receive, relay, transmit, store, analyze, or otherwise process information for or about one or more assets such as a locomotive. As another example, the system and application described herein may be hosted within a computing device such as a user device, a workshop system, or another computing device, that does not involve the cloud computing platform 130.

In the example of FIG. 1, the cloud computing environment is associated with one or more industrial systems (e.g., locomotives, etc.). In the system 100, locomotive data may be delivered to the cloud computing platform 130 via upload, download, or any other transmissions, from the locomotive 110, the workshop system 120, a server that receives data from the locomotive 110 across a network or local connection, and/or the like. The cloud computing platform 130 may reside in a local or sandboxed environment of a device such as a server, or can be distributed across multiple locations or devices and should not be construed as being limited to a single device. The system 100 can be configured to perform any one or more of data acquisition, data analysis, or data exchange with a locomotive, or with other task-specific processing devices related to aviation. Although not shown in the example of FIG. 1, the system 100 may also be connected to an asset community (e.g., turbines, healthcare, power, industrial, manufacturing, etc.) that is communicatively coupled with the cloud computing platform 130.

The user device 140 (e.g., computer, mobile device, workstation, tablet, laptop, appliance, kiosk, and the like) may be configured for data communication with the cloud computing platform 130. The user device 140 can be used to monitor or control the locomotive 110, or shipping plans, maintenance plans, repairs, and the like, related to the locomotive 110. In an example, information about a root cause of a failure of the locomotive 110 may be presented to an operator via a display of the user device 140. The user device 140 can include options and hardware for optimizing one or more features of the locomotive 110 or travel schedules of the locomotive 110 based on analytics performed at the cloud computing platform 130.

Although not shown in FIG. 1, the system 100 may include other devices and systems such as a device gateway that is configured to couple the locomotive 110 to the cloud computing platform 130. The device gateway can further couple the cloud computing platform 130 to one or more other assets or asset communities, an enterprise computing system, and/or other devices. The system 100 thus represents a scalable industrial solution that extends from a physical or virtual asset (e.g., the locomotive 110) to a remote cloud computing platform 130. The cloud computing platform 130 may optionally include one or more of a local, system, enterprise, or global computing infrastructure that can be optimized for industrial data workloads, secure data communication, and compliance with regulatory requirements.

A cloud computing system included within the platform 130 may include a Software-Defined Infrastructure (SDI) that serves as an abstraction layer above any specified hardware, such as to enable a data center to evolve over time with minimal disruption to overlying applications. The SDI enables a shared infrastructure with policy-based provisioning to facilitate dynamic automation, and enables SLA mappings to underlying infrastructure. This configuration can be useful when an application requires an underlying hardware configuration. The provisioning management and pooling of resources can be done at a granular level, thus allowing optimal resource allocation. In addition, the cloud computing system may be based on Cloud Foundry (CF), an open source PaaS that supports multiple developer frameworks and an ecosystem of application services. Cloud Foundry can make it faster and easier for application developers to build, test, deploy, and scale applications. Developers thus gain access to the vibrant CF ecosystem and an ever-growing library of CF services. Additionally, because it is open source, CF can be customized for IIoT workloads.

In a road failure scenario, the locomotive 110 may be transported to a workshop that includes workshop system 120. Information about the road failure and the maintenance of the locomotive 110 may be collected by the workshop system 120 and transported to the cloud computing platform 130. For example, the information may include textual data related to machine parameter readings, repair comments, material usage descriptions, symptom descriptions, defect descriptions, action comments, incident descriptions, part descriptions, root cause descriptions, symptom codes, and the like. The locomotive information may be received by an application that is described according to various embodiments and which is hosted by cloud computing platform 130. The application may normalize the textual data to clean the textual data to be a similar form. For example, the application may convert uppercase strings to lowercase, remove punctuation, remove English stop words (i.e., 'I', 'you,' 'do,' etc.), remove extra spaces and trailing spaces, convert abbreviations into standard definitions, perform word stemming, and the like. Accordingly, textual data from different sources may be normalized into a single form that is capable of being further processed by the application.

The cloud computing platform 130 may also store information about historical locomotive failures including root causes as well as one or more keywords associated with each respective root cause. For example, for a root cause of "radiator leaking causing low fluid" the keyword "radiator" and "fluid" may be stored. As another example, for a root cause of "nut backed off barring over switch/plug" the keywords may include "barring," "over," "switch," and "plug." It should be appreciated that information about hundreds of root causes and keywords associated with each respective root cause may be stored by the cloud computing platform 130.

In response to receiving information about a road failure event associated with the locomotive 110, the application hosted by the cloud computing platform 130 may determine a root cause for the current locomotive failure by determining a similarity of the keywords of each root cause of the historical road failures with respect to the received textual data of the current locomotive failure. Here, the application may select one or more root causes, for example, one, two, three, five, etc., having the most similarity to the current locomotive failure based on the determining and display the selected root causes for the current locomotive failure via a display of user device 140. For example, the user device 140 may a subscriber of, or otherwise have access to, the root failure determining application hosted by the cloud computing platform 130.

In addition, one or more analytics may further be processed by the cloud computing platform 130 based on the root causes determined by the application to identify further action that needs to be taken such as setting up additional maintenance to be performed on the locomotive 110 or other locomotives. In some cases, the determination of the root cause may be further determined based on additional information such as a type of the locomotive, a fleet number of the locomotive, a road number of the locomotive, a fleet name to which the locomotive belongs, and the like, to further improve accuracy of the determination. Furthermore, the application described herein has been tested to be just as accurate if not more accurate than human subject matter experts, and may be performed in a few seconds instead of the few weeks or even months that it takes a human.

FIG. 2 illustrates an example of determining weights for keywords of root causes and calculating similarities based thereon, in accordance with an example embodiment. In particular, FIG. 2 illustrates a first equation for calculating a weight of a keyword associated with a root cause of a previous locomotive failure and a second equation for calculating a similarity between keywords associated with a root cause of a previous locomotive failure and textual data associated with a current locomotive failure. In the field of locomotives, a root cause of locomotive failure may be represented by a description including text and phrases input by a user describing the locomotive failure as well as a root cause code which may be electronically assigned or manually assigned and which includes an abbreviated description of the root cause.

For example, a root cause description may include "radiator leaking fluid causing low fluid levels" while a root cause code may simply include "radiator fluid," or the like. In some examples herein, the keywords associated with a root cause may be the words included in the abbreviated root cause code, although the embodiments are not limited thereto. As another example, textual data associated with previous locomotive failures may be analyzed by the application described herein to identify keywords based on the textual data. For example, the textual data may include engineering notes, repair notes, fleet program manager diagnosis data (i.e., previous locomotive failure determinations by the fleet program manager), material usage, and the like, which may be analyzed to identify various keywords associated with a locomotive failure based the number of occurrences of specific words, and the like.

In the example of FIG. 2, the user interface 200 includes weights 210 allotted to different keywords, textual data 220 associated with current locomotive failures, keywords 230 associated with historical root causes, and similarity scores 240 determined based on the textual data 220 and the keywords 230. Here, the keywords 230 may be keywords associated with historical root causes of locomotive failure. In this example, the keywords 230 are the words included in a root cause code of a locomotive failure, however, the embodiments are not limited thereto. The textual data 220 comprises normalized data that may be provided from multiple different sources, for example, textual data related to machine parameter readings, repair comments, material usage descriptions, symptom descriptions, defect descriptions, action comments, incident descriptions, part descriptions, root cause descriptions, symptom codes, and the like. Prior to being analyzed, the raw textual data may be cleaned to generate textual data 220. For example, the raw text data may have uppercase strings converted to lowercase, punctuation removed, stop words removed, extra spaces and trailing spaces removed, abbreviations converted into standard definitions, word stemming performed, and the like, to generate textual data 220.

In the example of FIG. 2, the root cause codes are the keywords 230. Each word among the keywords 230 may be weighted using Equation 1. For example, keywords associated with a root cause of "water pump fail" include keywords 231 including "water" and "pump." Each of the keywords are then weighted using the following Equation 1:

$$\text{weight}(t) = \frac{|\{d \in D : t \in T_d \cap RCC_d\}|}{|\{d \in D : t \in T_d\}|} \qquad \text{Equation 1}$$

In this example, 't' represents a particular word, $|d \in D: t \in Td \cap RCCd|$ represents the frequency that the particular word T appears in both root cause code field and in the text fields, $|d \in D: t \in Td|$ represents the frequency that a particular word T only appears in all the text fields, T is a combination of all the text fields, and RCC is the root cause code field. The text fields refer to all sources of textual data 220 and may include repair data, parts information, engineer notes, material usage, and the like. Based on Equation 1, weights 210 for various keywords are determined. It should be appreciated that this is merely an example of determining weights. As another example, the weights may be determined manually, via a different equation, or the like.

Based on the weights 230 for each of the various keywords, similarities 240 may be determined for each group of keywords (e.g., root cause code). For example, the similarities 240 may be determined based on the following Equation 2:

$$\text{similarity}(T, RCC) = \sum_{w \in (T \cap RCC)} \frac{\text{weight}(w)}{|\{e \in RCC\}|} \qquad \text{Equation 2}$$

In this example, 'e' is the number of words in a root cause code field, weight (w) is a weight of a particular word, T is all the text fields, and RCC is the root cause code field. In the example of keywords 231 being compared with corresponding textual data 220, the similarity calculated by Equation 2 includes (¾) for the keyword "water" which is included in the text data 220 and (⁰⁄₄ for the keyword pump which is not weighted at all. Accordingly, the similarity results in ((¾)+0)/2=0.250 for a similarity score. In some examples, the similarity score of a plurality of root cause codes 230 may be determined for textual data 220 of a locomotive failure.

As a non-limiting example, similarities (e.g., similarity scores) for hundreds of root cause codes may be determined based on Equation 2, or another Equation or method. The application may select a single root cause code, or a predetermined amount of root cause codes, based on the determined similarities. For example, the application may select a root cause code having a greatest similarity score, the top two root causes, the top three root causes, and the like, and provide the selected root cause codes as the determined root cause for the current locomotive failure.

FIG. 3 illustrates an example of determining a list of root causes of a locomotive failure in accordance with an example embodiment, based on determined similarities. In this example, three work orders associated with a single locomotive failure (i.e., the same locomotive failure event) are analyzed. As an example, five root causes may be evaluated against textual data included in each of the work orders to determine a root cause of the locomotive failure (however, in actual implementation the number of root causes may be significantly higher such as hundreds or even thousands of root causes). In this example, the root cause codes (RCC1-RCC5) in window 300 correspond to historical root causes of previous locomotive failures, and work orders 1, 2, and 3 in window 300 correspond to textual data of a current locomotive failure. The application described according to various embodiments may calculate a similarity of the textual data with respect to historical root cause codes (RCC1-RCC5) to determine a probability that the root cause codes corresponding to the root cause of the locomotive failure. In this example, different work orders from the same locomotive failure result in different determinations of root causes as shown as recommendations in user interface 310.

In this example, the application selects the top three root causes and provides all three as recommendations. However, a different amount of root causes may be determined and provided (e.g., one, two, three, four, five, or more). Based on these recommendations, a user such as a fleet program manager can be assisted when performing a best guess of the root cause failure. As another example, the recommended root causes shown in user interface 310 may stand in the place of a fleet program manager thus removing the need for a human to make a determination as to the root cause of a locomotive failure all together.

Figure 4:
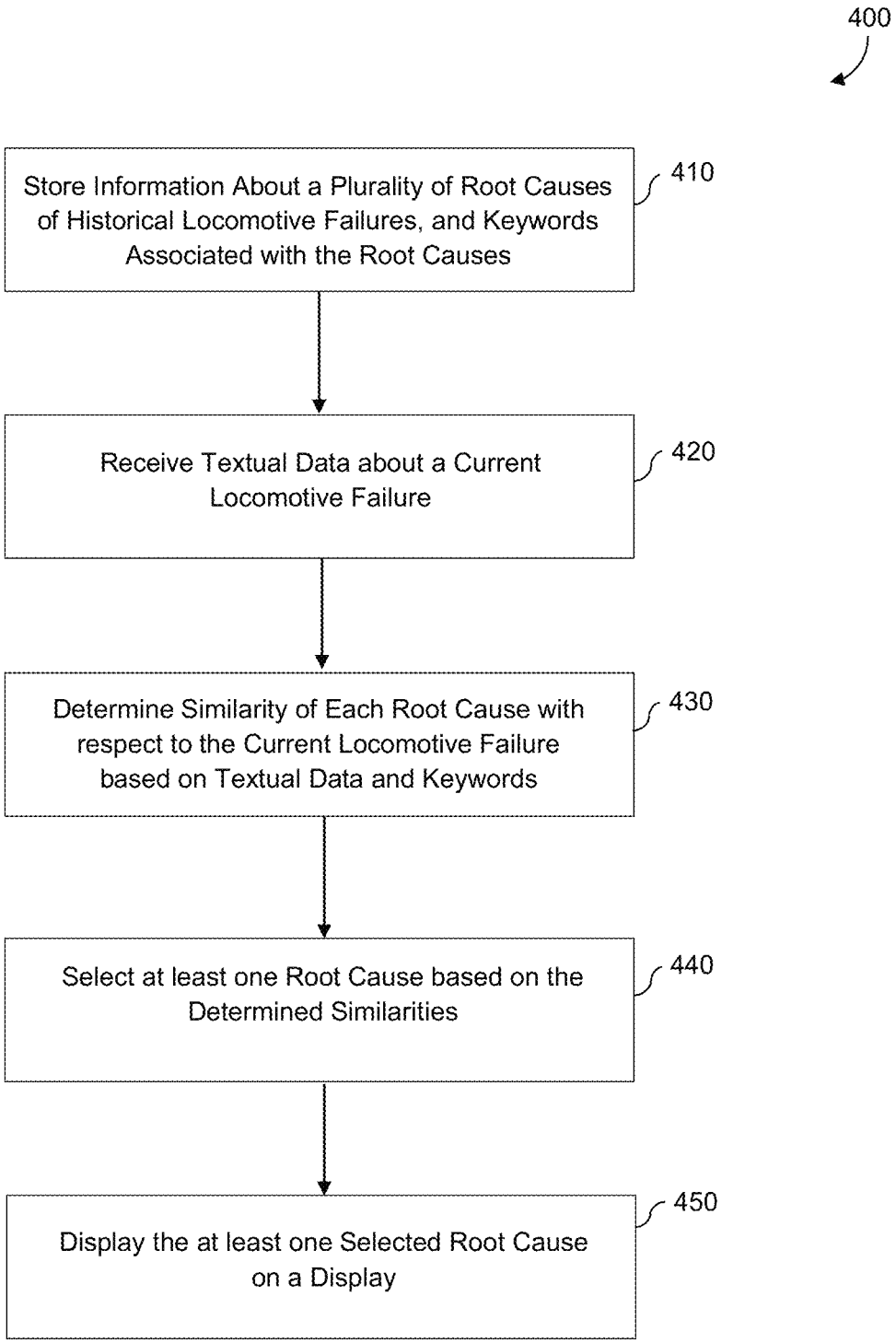
FIG. 4 is a diagram illustrating a method for determining a cause of locomotive failure in accordance with an example embodiment.

FIG. 4 illustrates a method 400 for determining a cause of locomotive failure in accordance with an example embodiment. For example, the method 400 may be performed by an application hosted by a computing device such as a cloud platform or another computing device that is not included within a cloud platform. Referring to FIG. 4, in 410 the method includes storing information about a plurality of root causes of previous locomotive failures including respective keywords associated with each root cause. For example, engineering notes, repair notes, fleet program manager diagnosis data, material usage, and the like, may be analyzed to identify various keywords associated with a locomotive failure. As another example, a root cause code corresponding to the root cause may be used as the respective keywords of a locomotive failure.

In 420, the method further includes receiving textual data associated with a current locomotive failure. For example, the textual data may be provided from multiple different sources, for example, textual data related to machine parameter readings, repair comments, material usage descriptions, symptom descriptions, defect descriptions, action comments, incident descriptions, part descriptions, root cause descriptions, symptom codes, and the like. The textual data may be processed from the different sources to generate normalized textual data having a same format. For example, the method may convert uppercase strings to lowercase, remove punctuation, remove stop words, remove extra spaces and trailing spaces, convert abbreviations into standard definitions, perform word stemming, and the like.

In 430, the method further includes determining a root cause for the current locomotive failure by determining a similarity of the keywords of each root cause with respect to the received textual data of the current locomotive failure, and in 440, selecting at least one root cause based on the determined similarities of the plurality of root causes. The determining in 430 may be performed for each root cause from among a plurality of root causes including (e.g., 5, 10, 20, 50, 100, or more root causes). For each root cause, a similarity of the keywords associated with the root cause and the textual data associated with a current locomotive failure may be determined. In some examples, the keywords of a root cause are weighted to emphasize at least one keyword that is more relevant to determining a similarity of the root cause with respect to the received textual data. The determining in 430 may include calculating a similarity score for each root cause based on a similarity between the textual data of the current locomotive failure and the respective keywords of that root cause, and the selecting in 440 may include selecting a root cause, from among a plurality of root causes, which has the greatest determined similarity score (or selecting a plurality of root causes having the top predetermined amount of similarity scores). In 450, the method includes displaying the at least one selected root cause for the current locomotive failure via a display device.

Figure 5:
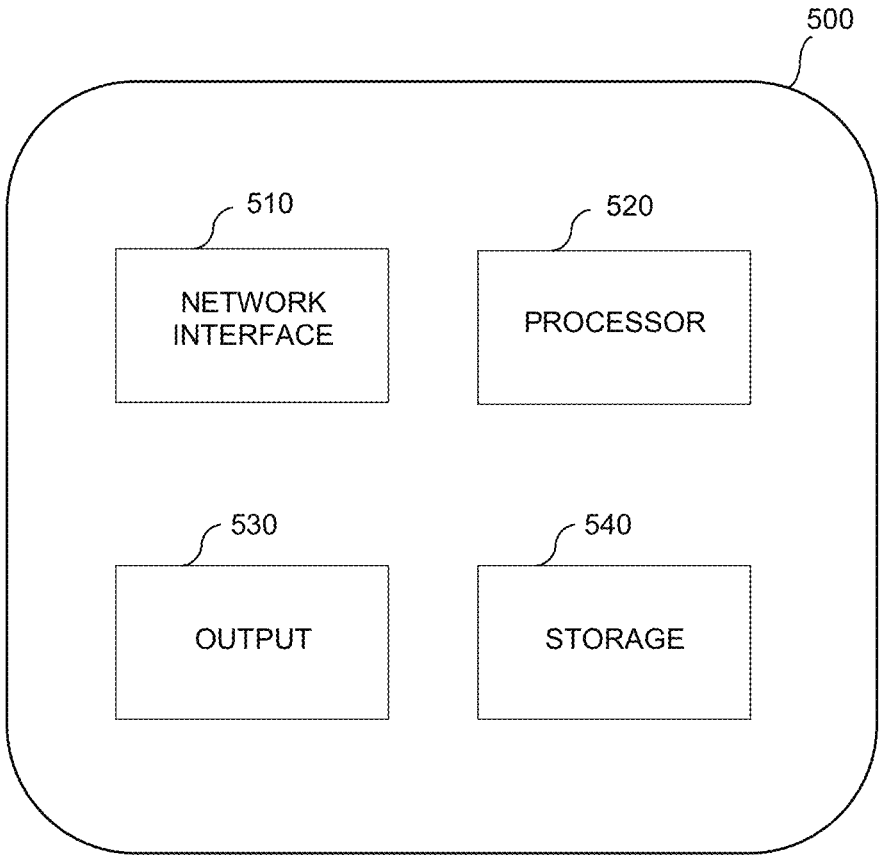
FIG. 5 is a diagram illustrating a computing device for determining a cause of locomotive failure in accordance with an example embodiment.

FIG. 5 illustrates a computing device 500 for determining a cause of locomotive failure in accordance with an example embodiment. For example, the computing device 500 may be a cloud computing device such as cloud platform 130 shown in FIG. 1, or a computing device that is not part of a cloud platform such as a server, user device, workstation, and the like. The computing device 500 may perform the method 400 of FIG. 4 and may host an application for determining locomotive failure. Referring to FIG. 5, the device 500 includes a network interface 510, a processor 520, an output 530, and a storage device 540. Although not shown in FIG. 5, the device 500 may include other components such as a display, an input unit, a receiver/transmitter, and the like. The network interface 510 may transmit and receive data over a network such as the Internet, a private network, a public network, and the like. The network interface 510 may be a wireless interface, a wired interface, or a combination thereof. The processor 520 may include one or more processing devices each including one or more processing cores. In some examples, the processor 520 is a multicore processor or a plurality of multicore processors. Also, the processor 520 may be fixed or it may be reconfigurable. The output 530 may output data to an embedded display of the device 500, an externally connected display, a cloud, another device, and the like. The storage device 540 is not limited to any particular storage device and may include any known memory device such as RAM, ROM, hard disk, and the like.

The storage device 540 may store information about a plurality of root causes of previous locomotive failures including respective keywords associated with each root cause. The keywords may be input manually by a user, the keywords may be words determined included in a root cause code, the keywords may be automatically determined by the application described herein based on textual data associated with previous locomotive failures, and the like. The network interface 510 may receive textual data associated with a current locomotive failure. The textual data may be provided and received from different sources and may have different formats and different styles. The different sources of textual data may include one or more of locomotive symptom descriptions, preliminary diagnosis, repair comments, material usage, and machine parameter readings, and the like, associated with the locomotive failure. In this case, the processor 520 may further process the textual data received from different sources to generate normalized textual data having a same format and style, thereby making the textual data easier to analyze.

The processor 520 may determine a root cause for the current locomotive failure by determining a similarity of the keywords of each root cause with respect to the received textual data of the current locomotive failure. The processor 520 may select at least one root cause based on the determined similarities of the plurality of root causes and the output 530 may display the at least one selected root cause for the current locomotive failure via a display device (not shown). In some embodiments, the processor 520 may calculate a similarity score for each root cause based on a similarity between the textual data of the current locomotive failure and the respective keywords of the root cause. Here, the processor 520 may select a root cause or a predetermined amount of root causes, from among the plurality of root causes, which have the greatest determined similarity score. In some embodiments, the processor may determine weights for the keywords of a root cause to emphasize at least one keyword that is more relevant to determining a similarity of the root cause with respect to the received textual data.

Figure 6:
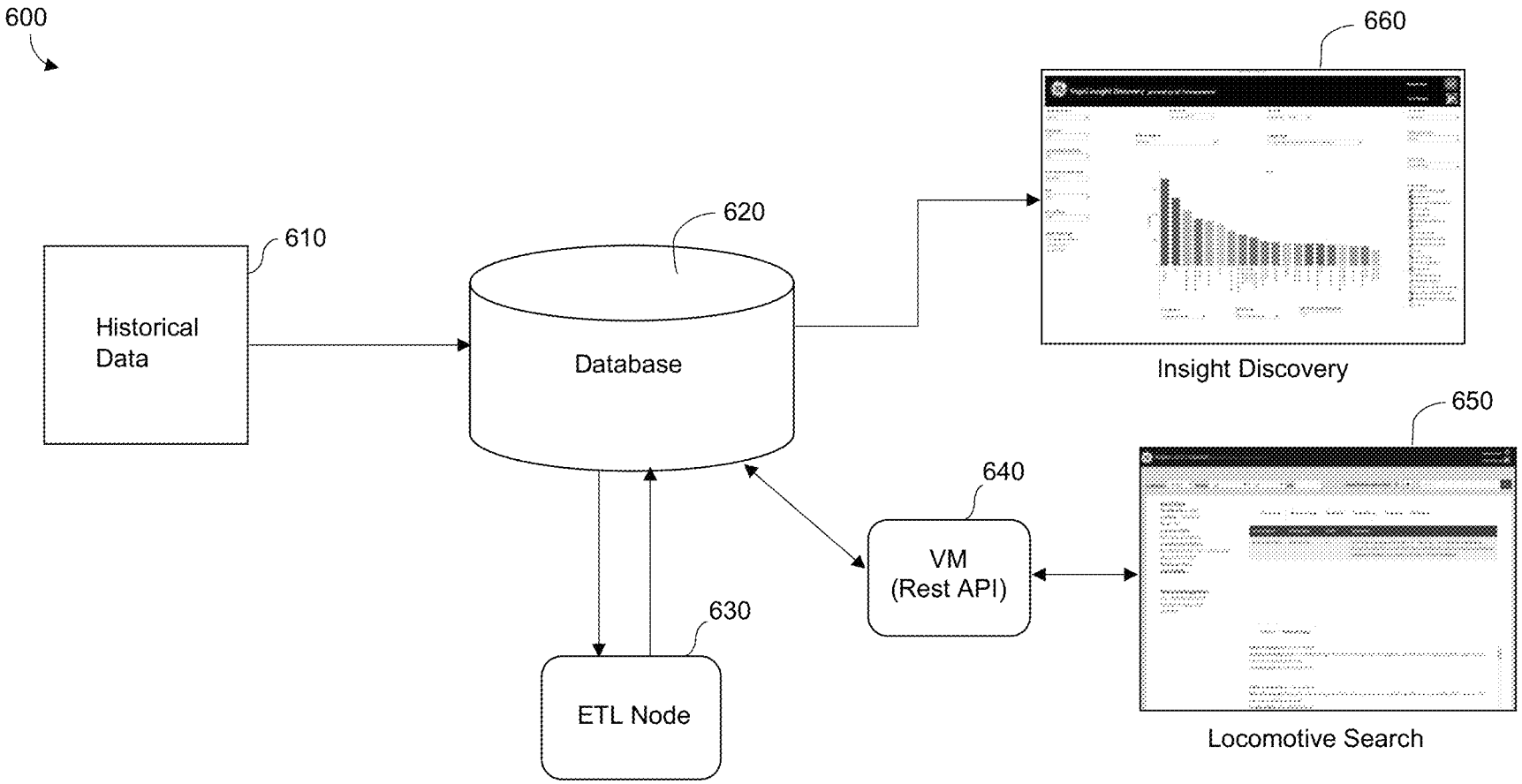
FIG. 6 is a diagram illustrating a system for generating and providing a user interface for determining a root cause of locomotive failure in accordance with an example embodiment.

FIG. 6 illustrates a system 600 for generating and providing a user interface for determining a root cause of locomotive failure in accordance with an example embodiment. In the example of FIG. 6, the system 600 includes a central database 620 which may be a server, a cloud computing system, a computer, a web server, and the like. The database 620 provides a user interface that provides a user the ability to interact with the locomotive failure software described herein. In this example, historical data 610 is provided to the database 620 on a periodic basis such as daily, weekly, and the like. An ETL (Extract, Transform, Load) node 630 may perform learning based on the historical data 610 and generate a listing of predetermined root causes of locomotive failure and associate the root causes with various keywords and weights as described in the examples herein. For example, the ETL node 630 may process the historical data 610 and calculate weights, keywords, relevance, etc., associated with each cause of historic locomotive failures included in the historical data 610. Furthermore, the ETL node 630 may receive new locomotive failure data and process the new locomotive failure data (e.g., in real-time) to determine a cause of failure for the new locomotive failure and output one or more determined causes of the locomotive failure to a user interface such as interface 650 and/or 660.

In this example, user interface 650 may include an input that enables a user to input information about a locomotive failure (e.g., notes, repairs, parts replaced, etc.) and access the locomotive determining software (e.g., analytics) on the ETL node 630 via the database 620. Based on the input locomotive failure information the analytic may provide the user with information about the locomotive failure including one or more determined causes as well as additional information such as possible replacement parts, similar failures, and the like. As another example, the user interface 650 may further include a search bar that enables a user to search through previous failures. For example, the search may be performed by the virtual machine (VM) 640. Here, the search may be performed based on a fleet number, a predetermined time period, a company, a geographic location, a type of failure, and the like. The search may return information about failures meeting the search criteria as well as additional information related to the failures such as parts replaced, repair notes, and the like, as well as provide recommendations. Accordingly, a subject matter expert could use the interface 650 to assist in making an expert decision. In another example, user interface 660 may provide a dashboard as well as other features that give users a history of their own searches, previous failures accessed, types of failures accessed, and the like.

As will be appreciated based on the foregoing specification, the above-described examples of the disclosure may be implemented using computer programming or engineering techniques including computer software, firmware, hardware or any combination or subset thereof. Any such resulting program, having computer-readable code, may be embodied or provided within one or more non transitory computer-readable media, thereby making a computer program product, i.e., an article of manufacture, according to the discussed examples of the disclosure. For example, the non-transitory computer-readable media may be, but is not limited to, a fixed drive, diskette, optical disk, magnetic tape, flash memory, semiconductor memory such as read-only memory (ROM), and/or any transmitting/receiving medium such as the Internet, cloud storage, the internet of things, or other communication network or link. The article of manufacture containing the computer code may be made and/or used by executing the code directly from one medium, by copying the code from one medium to another medium, or by transmitting the code over a network.

The computer programs (also referred to as programs, software, software applications, "apps", or code) may include machine instructions for a programmable processor, and may be implemented in a high-level procedural and/or object-oriented programming language, and/or in assembly/machine language. As used herein, the terms "machine-readable medium" and "computer-readable medium" refer to any computer program product, apparatus, cloud storage, internet of things, and/or device (e.g., magnetic discs, optical disks, memory, programmable logic devices (PLDs)) used to provide machine instructions and/or data to a programmable processor, including a machine-readable medium that receives machine instructions as a machine-readable signal. The "machine-readable medium" and "computer-readable medium," however, do not include transitory signals. The term "machine-readable signal" refers to any signal that may be used to provide machine instructions and/or any other kind of data to a programmable processor.

The above descriptions and illustrations of processes herein should not be considered to imply a fixed order for performing the process steps. Rather, the process steps may be performed in any order that is practicable, including simultaneous performance of at least some steps. Although the disclosure has been described in connection with specific examples, it should be understood that various changes, substitutions, and alterations apparent to those skilled in the art can be made to the disclosed embodiments without departing from the spirit and scope of the disclosure as set forth in the appended claims.

What is claimed is:

1. A computing system comprising:

a storage configured to store information about a plurality of root causes of previous equipment failures including respective keywords associated with each root cause;

a network interface configured to receive textual data associated with a current equipment failure;

a processor configured to determine a root cause for the current equipment failure by determining a similarity of the keywords of each root cause with respect to the received textual data of the current equipment failure, and select at least one root cause based on the determined similarities of the plurality of root causes; and an output configured to provide information about the at least one selected root cause for the current equipment failure for display via a display device.

2. The computing system of claim 1, wherein keywords associated with a root cause comprise keywords included in a root cause code of the root cause.

3. The computing system of claim 1, wherein the network interface is configured to receive different sources of textual data associated with the current equipment failure.

4. The computing system of claim 3, wherein the different sources of textual data comprise two or more of: symptom descriptions, preliminary diagnosis, repair comments, material usage, and machine parameter readings, associated with the current equipment failure.

5. The computing system of claim 4, wherein the processor is further configured to process the textual data received from different sources to generate normalized textual data having a same format, prior to determining the at least one root cause of the current equipment failure.

6. The computing system of claim 1, wherein the processor is further configured to calculate a similarity score for each root cause based on a similarity between the textual data of the current equipment failure and the respective keywords of the root cause.

7. The computing system of claim 6, wherein the processor is further configured to select a root cause, from among the plurality of root causes, which has the greatest determined similarity score.

8. The computing system of claim 1, wherein the keywords of a root cause are weighted to emphasize at least one keyword that is more relevant to determining a similarity of the root cause with respect to the received textual data.

9. The computing system of claim 1, wherein the processor is configured to determine a plurality of root causes for the current equipment failure based on the similarities, and rank the plurality of determined root causes, and the output is configured to provide information concerning the plurality of determined root causes for the current equipment failure based on the ranking for display via the display device.

10. A computer-implemented method comprising:

storing information about a plurality of root causes of previous equipment failures including respective keywords associated with each root cause;

receiving textual data associated with a current equipment failure;

determining a root cause for the current equipment failure by determining a similarity of the keywords of each root cause with respect to the received textual data of the current equipment failure and selecting at least one root cause based on the determined similarities of the plurality of root causes; and outputting information about the at least one selected root cause for the current equipment failure for display via a display device.

11. The computer-implemented method of claim 10, wherein keywords associated with a root cause comprise keywords included in a root cause code of the root cause.

12. The computer-implemented method of claim 10, wherein the receiving comprises receiving different sources of textual data associated with the current equipment failure.

13. The computer-implemented method of claim 12, wherein the different sources of textual data comprise two or more of: symptom descriptions, preliminary diagnosis, repair comments, material usage, and machine parameter readings, associated with the current equipment failure.

14. The computer-implemented method of claim 13, wherein the receiving further comprises processing the textual data received from different sources to generate normalized textual data having a same format, prior to determining the at least one root cause of the current equipment failure.

15. The computer-implemented method of claim 10, wherein the determining the similarity comprises calculating a similarity score for each root cause based on a similarity between the textual data of the current equipment failure and the respective keywords of the root cause.

16. The computer-implemented method of claim 15, wherein the selecting comprises selecting a root cause, from among the plurality of root causes, which has the greatest determined similarity score.

17. The computer-implemented method of claim 10, wherein the keywords of a root cause are weighted to emphasize at least one keyword that is more relevant to determining a similarity of the root cause with respect to the received textual data.

18. The computer-implemented method of claim 10, wherein the determining the root cause comprises determining a plurality of root causes for the current equipment failure based on the similarities, and ranking the plurality of determined root causes, and the outputting comprises outputting information concerning the plurality of determined root causes for the current equipment failure based on the ranking for display via the display device.

19. A non-transitory computer readable medium having stored therein instructions that when executed cause a computer to perform a method comprising:

storing information about a plurality of root causes of previous equipment failures including respective keywords associated with each root cause;

receiving textual data associated with a current equipment failure;

determining a root cause for the current equipment failure by determining a similarity of the keywords of each root cause with respect to the received textual data of the current equipment failure and selecting at least one root cause based on the determined similarities of the plurality of root causes; and outputting information about the at least one selected root cause for the current equipment failure for display via a display device.

20. The non-transitory computer readable medium of claim 19, wherein the determining the similarity comprises calculating a similarity score for each root cause based on a similarity between the textual data of the current equipment failure and the respective keywords of the root cause, and the selecting comprises selecting a root cause, from among the plurality of root causes, which has the greatest determined similarity score.

21. The computing system of claim 1, wherein the processor determines the similarity of keywords of a root cause with respect to the received textual data of an equipment failure that has already occurred based on a number of occurrences of each keyword of the respective root cause in the textual data of the equipment failure that has already occurred.

* * * * *